US009464800B2

(12) United States Patent
Kim et al.

(10) Patent No.: US 9,464,800 B2
(45) Date of Patent: Oct. 11, 2016

(54) LIGHT EMITTING MODULE

(71) Applicant: SAMSUNG ELECTRONICS CO., LTD., Suwon-Si, Gyeonggi-do (KR)

(72) Inventors: Dong Wook Kim, Suwon-Si (KR); Se Mook Lim, Seoul (KR); Woo Suck Jang, Seoul (KR); Myoung Sik Jung, Bucheon-Si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 105 days.

(21) Appl. No.: 14/455,727

(22) Filed: Aug. 8, 2014

(65) Prior Publication Data

US 2015/0198320 A1 Jul. 16, 2015

(30) Foreign Application Priority Data

Jan. 13, 2014 (KR) ..... 10-2014-0004204

(51) Int. Cl.

| | |
|---|---|
| ***F21V 29/00*** | (2015.01) |
| ***F21V 29/71*** | (2015.01) |
| ***F21K 99/00*** | (2016.01) |
| ***F21V 19/00*** | (2006.01) |
| ***F21V 23/00*** | (2015.01) |
| ***F21V 29/77*** | (2015.01) |
| *F21Y 101/02* | (2006.01) |
| *F21V 3/00* | (2015.01) |

(52) U.S. Cl.

CPC ..... *F21V 29/713* (2015.01); *F21K 9/135* (2013.01); *F21V 19/003* (2013.01); *F21V 23/007* (2013.01); *F21V 29/773* (2015.01); *F21V 3/00* (2013.01); *F21Y 2101/02* (2013.01)

(58) Field of Classification Search

CPC ..... F21V 9/20; F21V 9/89; F21K 9/00; F21K 9/13

USPC ..... 362/294, 249.02, 249.08

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |

(Continued)

FOREIGN PATENT DOCUMENTS

| | | |
|---|---|---|
| JP | 2012-089450 A | 5/2012 |
| JP | 2012-164518 A | 8/2012 |

(Continued)

*Primary Examiner* — Ali Alavi

(74) *Attorney, Agent, or Firm* — Lee & Morse P.C.

(57) ABSTRACT

A light emitting module includes a light source board having a first surface and a second surface opposing the first surface and extending from one end to the other end, forming a spiral shape; at least one light source disposed on the first surface of the light source board; and a heat dissipation plate disposed on the second surface of the light source board and provided with a contact surface having a spiral shape corresponding to that of the light source board.

14 Claims, 19 Drawing Sheets

(56) References Cited

U.S. PATENT DOCUMENTS

| | | | | |
|---|---|---|---|---|
| 7,288,758 | B2 | 10/2007 | Sherrer et al. | |
| 7,319,044 | B2 | 1/2008 | Han et al. | |
| 7,501,656 | B2 | 3/2009 | Han et al. | |
| 7,572,033 | B2 * | 8/2009 | Sun | F21V 29/004 257/722 |
| 7,591,575 | B2 * | 9/2009 | Hama | A61B 1/00096 362/231 |
| 7,663,229 | B2 | 2/2010 | Lu et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 9,175,811 | B2 * | 11/2015 | Van De Ven | F21K 9/00 |
| 2012/0307505 | A1 | 12/2012 | Chen | |
| 2013/0044470 | A1 | 2/2013 | Wu et al. | |

FOREIGN PATENT DOCUMENTS

| | | | |
|---|---|---|---|
| KR | 10-2010-0117451 | A | 11/2010 |
| KR | 10-1101241 | B1 | 12/2011 |
| KR | 10-2013-0054864 | A | 5/2013 |

* cited by examiner

LIGHT EMITTING MODULE

CROSS-REFERENCE TO RELATED APPLICATION

This application claims the benefit of Korean Patent Application No. 10-2014-0004204 filed on Jan. 13, 2014, with the Korean Intellectual Property Office, the disclosure of which is incorporated herein by reference.

BACKGROUND

The present disclosure relates to a light emitting module.

Compared with filament-based light emitting devices, light emitting diodes (LEDs) have various advantages such as relatively long lifespans, low degrees of power consumption, excellent initial driving characteristics, high vibration resistance, and the like, and thus, demand for LEDs continues to grow. In particular, after the development of nitride light emitting devices, light emitting modules using semiconductor light emitting devices have been extendedly utilized and employed in downlights, bulb-type lighting, surface lighting, and the like. Thus, the enhancement of efficiency of components used in manufacturing light emitting modules and the development of heat dissipation structures for effectively dissipating heat generated by light emitting devices are required.

SUMMARY

An aspect of the present disclosure may provide a light emitting module having improved heat dissipation performance and excellent production cost competitiveness.

However, aspects of the present disclosure are not limited thereto and aspects that may be recognized from technical solutions or embodiments described hereinafter may also be included although not explicitly mentioned.

According to an aspect of the present disclosure, a light emitting module may include: a light source board having a first surface and a second surface opposing the first surface and extending from one end to the other end, forming a spiral shape; at least one light source disposed on the first surface of the light source board; and a heat dissipation plate disposed on the second surface of the light source board and provided with a contact surface having a spiral shape corresponding to that of the light source board.

The contact surface of the heat dissipation plate may be provided with an exposed region not covered by the second surface of the light source board.

The heat dissipation plate may further include a stoppage protrusion disposed on the exposed region and contacting at least one of a lateral surface and the other end of the light source board.

The light source board may further include at least one first protrusion disposed on the second surface thereof, and the heat dissipation plate may further include at least one first recess disposed in the contact surface thereof and accommodating the at least one first protrusion.

The heat dissipation plate may further include at least one second protrusion disposed on the contact surface, and the light source board may further include at least one second recess disposed in the second surface and accommodating the at least one second protrusion.

The light source board may include at least one first through hole penetrating through the light source board and provided to match the spiral shape of the light source board and the spiral shape of the contact surface provided in the heat dissipation plate, and the heat dissipation plate may include at least one second through hole penetrating through the heat dissipation plate in a position corresponding to the first through hole of the light source board and having a shape corresponding to that of the first through hole.

The first through hole may be disposed in at least one of a region adjacent to one end of the light source board and a region adjacent to the other end of the light source board.

The light source board may further include a first concavo-convex portion disposed in at least a portion of a lateral surface thereof and provided to match the spiral shape of the light source board and the spiral shape of the contact surface provided in the heat dissipation plate, and the heat dissipation plate may further include a second concavo-convex portion disposed in a lateral surface thereof corresponding to the first concavo-convex portion of the light source board and having a shape corresponding to that of the first concavo-convex portion.

A lateral surface of the light source board may have a cutaway surface cut using a V-cutting process.

The light source board may be a printed circuit board (PCB) on which a wiring pattern providing driving power to the at least one light source is formed.

The first surface of the light source board may be provided as a reflective surface.

A thickness of the light source board may range from about 0.6 mm to about 1.6 mm.

The light source may include a semiconductor light emitting device.

The heat dissipation plate may include at least one of materials selected from the group consisting of Ag, Al, Ni, Cr, Cu, Au, Pd, Pt, Sn, W, Rh, Ir, Ru, Mg, Zn, Ti, and alloys thereof.

According to another aspect of the present disclosure, a light emitting module may include: a plurality of light sources; a light source board having a first surface on which the plurality of light sources are disposed and a second surface opposing the first surface, and having a first spiral shape; and a heat dissipation plate disposed on the second surface of the light source board, and extending from one end to the other end, forming a second spiral shape corresponding to the first spiral shape.

The foregoing technical solutions do not fully enumerate all of the features of the present disclosure. The foregoing and other objects, features, aspects and advantages of the present disclosure will become more apparent from the following detailed description of the present disclosure when taken in conjunction with the accompanying drawings.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
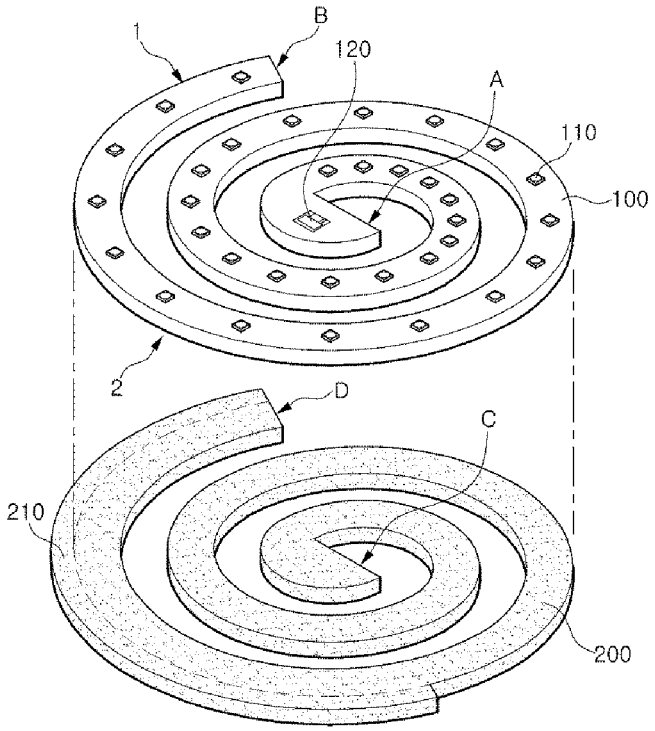
FIG. 1 is a perspective view illustrating a light emitting module according to an exemplary embodiment of the present disclosure.

Hereinafter, exemplary embodiments of the present inventive concept will be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a perspective view illustrating a light emitting module according to an exemplary embodiment of the present inventive concepts.

Referring to FIG. 1, a light emitting module according to the exemplary embodiment includes at least one light source 110, a light source board 100, and a heat dissipation plate 200.

Any device may be used as the light source 110 as long as it can emit light. For example, the light source 110 may be a light emitting device package including a semiconductor light emitting device, but the light source 110 may also be a semiconductor light emitting device directly mounted on the light source board 100. The light source 110 may include a combination of devices emitting light having predetermined wavelengths and emitting different colors of light to form white light, or may include a wavelength conversion material such as a phosphor.

The light source board 100 includes a first surface 1 and a second surface 2 opposing the first surface 1. At least one light source 110 may be disposed on the first surface 1. In this case, the first surface 1 may be provided as a reflective surface effectively reflecting light emitted from the light source 110. In the exemplary embodiment, a plurality of light sources 110 are disposed on the first surface 1, but the present disclosure is not limited thereto. The light source board 100 may include a connector 120 for exchanging an electrical signal externally.

A circuit board used in the art, for example, a printed circuit board (PCB), a metal-core printed circuit board (MCPCB), a metal printed circuit board (MPCB), a flexible printed circuit board (FPCB), and the like, may be used as the light source board 100. In this case, the light source board 100 may include a wiring pattern formed on a surface, an interior, or the like, thereof. The wiring pattern may provide driving power to the at least one light source 110.

In the present exemplary embodiment, the light source board 100 may extend from one end A to the other end B, forming a spiral shape. For example, as illustrated in FIG. 1, the light source board 100 extends, starting from the one end A, in a direction away from the one end A to the other end B, forming a vortex shape, and may have a flat spiral shape overall.

Hereinafter, a process of manufacturing the light source board 100 according to the present exemplary embodiment will be described briefly with reference to FIGS. 2A through 2C.

Figure 2A:
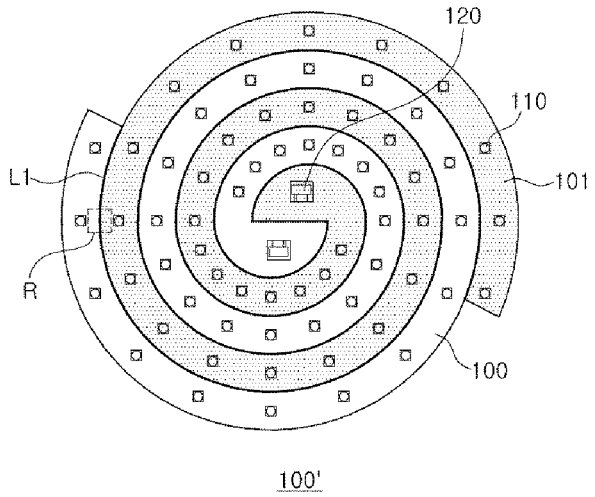
FIGS. 2A through 2C are plan views and a cross-sectional view illustrating a light source board according to an exemplary embodiment of the present disclosure.
Figure 2B:
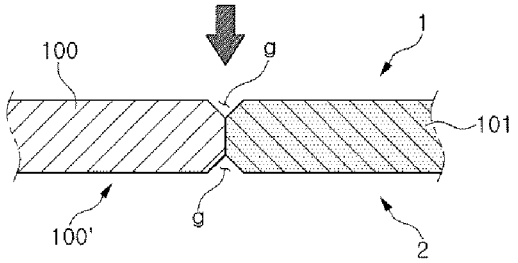
Figure 2C:
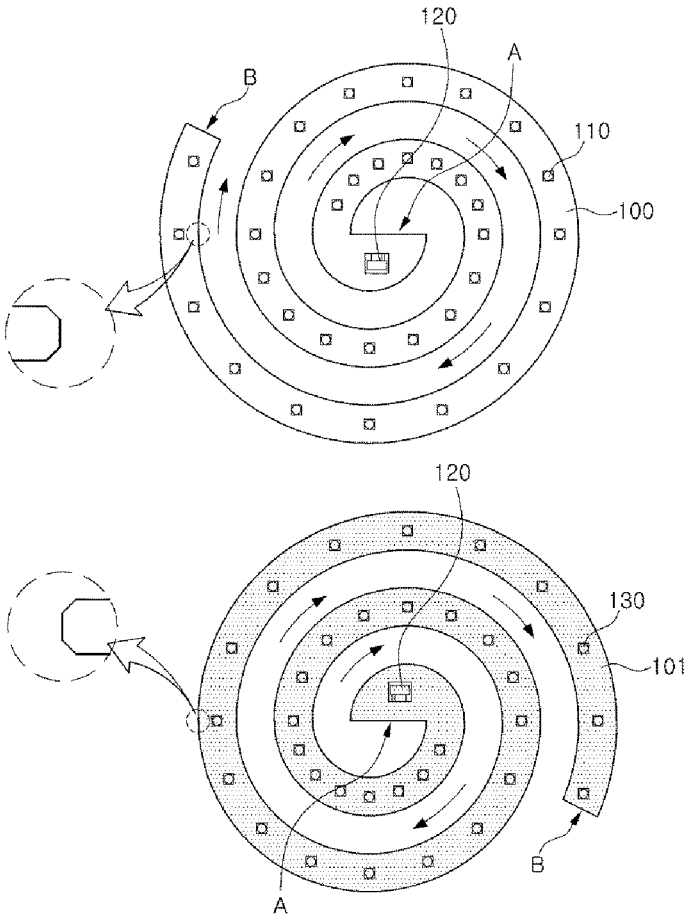

First, as illustrated in FIG. 2A, the light source board 100 according to the present exemplary embodiment may be separated from a single mother board 100' so as to be respectively provided as light source boards 100 and 101. For example, the mother board 100' may have a circular shape and may be cut to be separated into the two spiral light source boards 100 and 101 through a V-cutting process. In detail, FIG. 2B is an enlarged plan view of a region "R" of FIG. 2A. Here, when the V-cutting process is applied, keyways g are formed along a cutting line L1 on the first surface 1 and the second surface 2 of the mother board 100', and thereafter, when a predetermined amount of pressure is applied to the region of the keyways g, the mother board 100' may be separated into two light source boards 100 and 101 each having a spiral shape. In this case, the respective spiral light source boards 100 and 101 may have a lateral surface as a section cut in the V-cut process.

In this manner, in the present exemplary embodiment, two light source boards 100 and 101 are obtained from the single mother board 100', rather than the single mother board 100' being employed as a single light source board, price competitiveness may be effectively improved. In addition, since air circulates between the lateral surfaces of the light source boards 100 and 101 (see arrow), a heat dissipation effect may be increased.

The thickness of the light source board 100 may range, for example, from approximately 0.6 mm to 1.6 mm, but the present disclosure is not limited thereto. When the light source board 100 is formed to be thin, costs for components may be reduced and heat conduction may be improved, and further, ease of cutting the light source board 100 from the mother board 100' may be increased.

Hereinafter, the other components of the light emitting module according to the exemplary embodiment of the present disclosure will be described with reference back to FIG. 1.

Referring to FIG. 1, the light emitting module according to the present exemplary embodiment includes the heat dissipation plate 200 disposed on the second surface 2 of the light source board 100. The heat dissipation plate 200 may have a contact surface in contact with the light source board 100 and easily dissipate heat generated by the light sources 110 disposed on the first surface 1 of the light source board 100 through heat conduction.

The heat dissipation plate 200 may be formed of a metal having excellent thermal conductivity. For example, the heat dissipation plate 200 may include at least one of materials Ag, Al, Ni, Cr, Cu, Au, Pd, Pt, Sn, W, Rh, Ir, Ru, Mg, Zn, Ti, and an alloy thereof. However, the present disclosure is not limited thereto. Namely, the heat dissipation plate 200 may be formed of one or more of semiconductor such as ceramic, silicon (Si), germanium (Ge), and the like, and a resin, and may be formed any material as long as the material has excellent thermal conductivity.

In the present exemplary embodiment, the heat dissipation plate 200 may have a spiral contact surface corresponding to the spiral shape of the light source board 100. If the light source board 100 has a first spiral shape, the heat dissipation plate 200 may extend from one end C to the other end D, forming a second spiral shape, and here, the first and second spiral shapes may be understood as corresponding to be matched to each other.

Namely, the heat dissipation plate 200 may be provided to serve to conduct heat transmitted from the light source board 100 and dissipate the heat outwardly, and in this case, the heat dissipation plate 200 does not greatly conduct heat, other than at regions thereof being in directly contact with the light source board 100. Thus, in consideration of the fact that the light source board 100 has a spiral shape, the heat dissipation plate 200 according to the present exemplary embodiment is also formed to have a spiral shape corresponding to that of the light source board 100, thus reducing costs and increasing heat dissipation due to air circulation.

Meanwhile, in the present exemplary embodiment, the contact surface of the heat dissipation plate 200 may include an exposed region 210 not covered by the second surface 2 of the light source board 100. The exposed region 210 may increase surface area of the heat dissipation plate 200, further increasing heat dissipation efficiency.

Figure 3A:
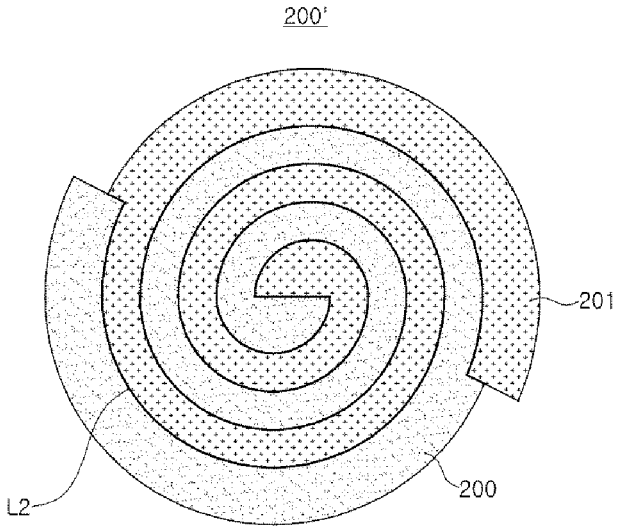
FIGS. 3A and 3B are plan views illustrating a heat dissipation plate according to an exemplary embodiment of the present disclosure.
Figure 3B:
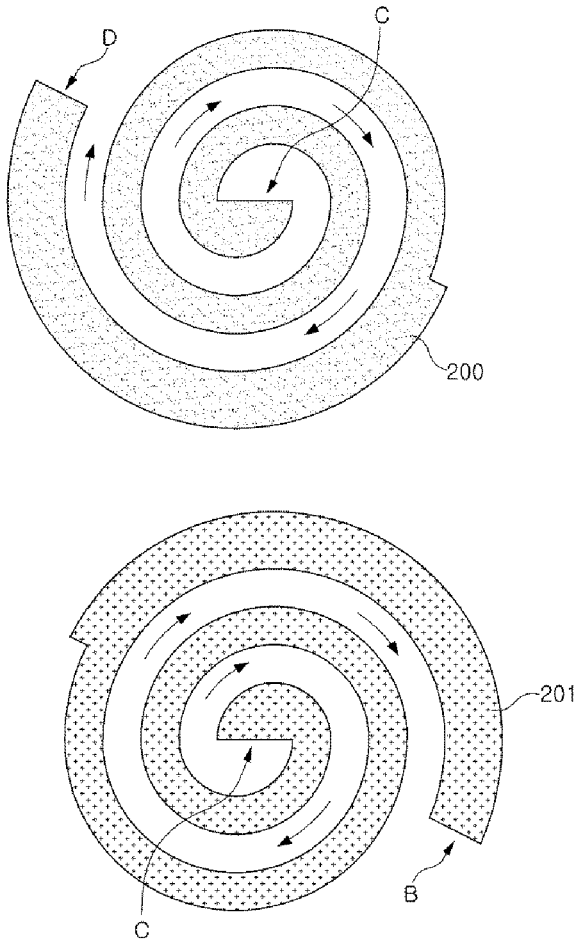

Similar to the process of manufacturing the light source board 100 as described above, the heat dissipation plate 200 may be separated from a single mother heat dissipation plate 200' so as to be provided as respective heat dissipation plates 200 and 201. For example, as illustrated in FIGS. 3A and 3B, the mother heat dissipation plate 200' may have a circular shape and may be cut into two spiral heat dissipation plates 200 and 201 along a cut line L2.

The two heat dissipation plates 200 and 201, rather than the single mother heat dissipation plate 200' being employed as a single heat dissipation plate, may effectively improve price competitiveness, and in addition, air circulation (see arrow indication) between the lateral surfaces of the heat dissipation plates 200 and 200' provides an excellent heat dissipation effect.

Meanwhile, the light source board 100 and a contact surface of the heat dissipation plate 200 may be disposed such that the spiral shapes of the light source board 100 and the heat dissipation plate 200 (for example, the first spiral shape of the light source board 100 and the second spiral shape of the contact surface provided in the heat dissipation plate 200) are matched.

In other words, the contact surface of the heat dissipation plate 200 may have the second spiral shape corresponding to the first spiral shape and need to be disposed in a position in which the first spiral shape and the second spiral shape are matched, on the second surface 2 of the light source board 100. This configuration aims at maximizing contact area between the light source board 100 having a particular shape and the heat dissipation plate 200 having a particular shape corresponding to that of the light source board 100, to thus further increase heat dissipation efficiency.

Hereinafter, a structure facilitating matching between the first spiral shape of the light source board 100 and the second spiral shape of the contact surface provided in the heat dissipation plate 200 will be described.

Figure 4A:
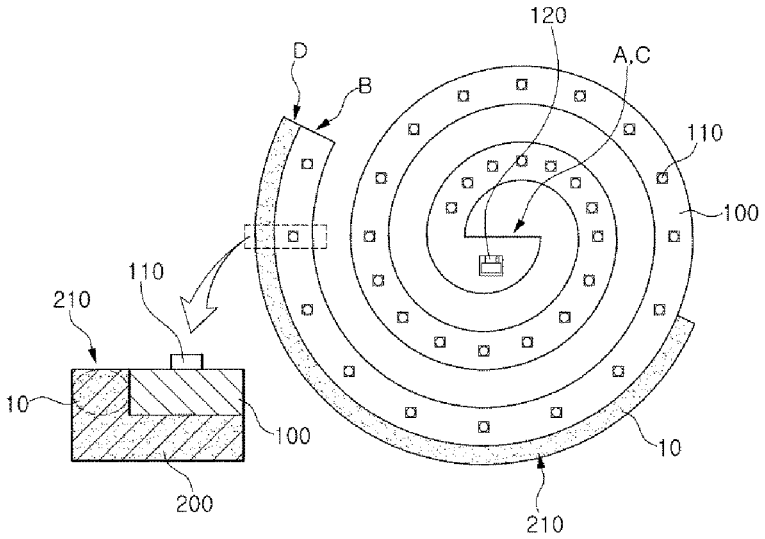
FIGS. 4A through 8D are views illustrating a light emitting module according to a modified embodiment of FIG. 1.
Figure 4B:
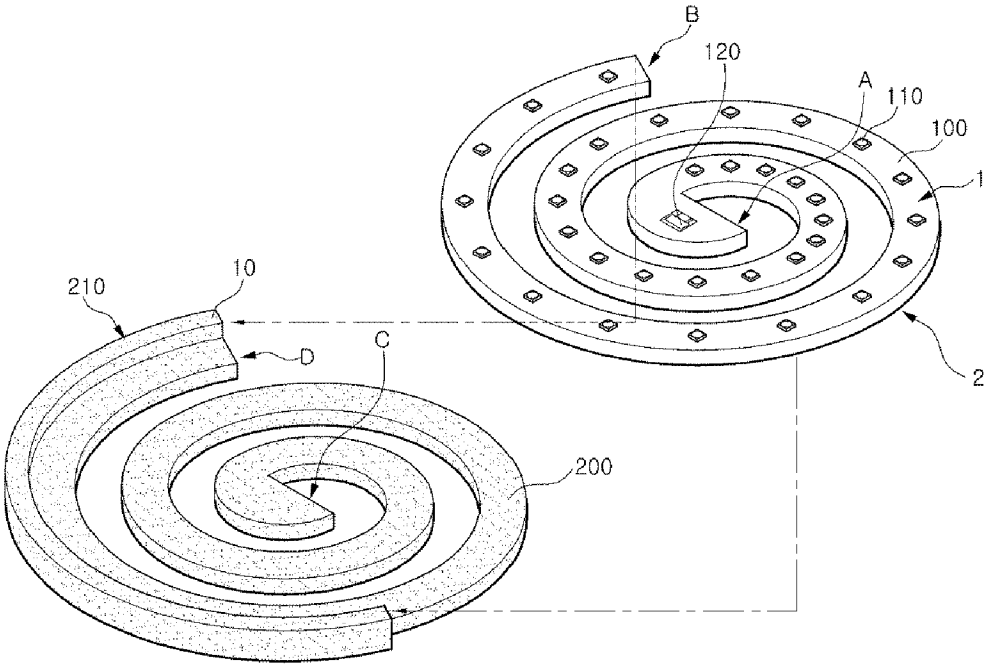

FIGS. 4A and 4B are a plan view and a perspective view illustrating a light emitting module according to a modified exemplary embodiment of FIG. 1. Hereinafter, detailed descriptions of matters that may be applied in the same manner as those of the former exemplary embodiment will be omitted and different components or additional components will be largely described.

Referring to FIG. 4A, a contact surface of a heat dissipation plate 200 according to the present exemplary embodiment further includes an exposed region 210 not covered by the second surface 2 of the light source board 100. Here, a stoppage protrusion 10 in contact with a lateral surface of the light source board 100 may be formed on the exposed region 210.

The stoppage protrusion 10 may be defined as a partition protruded from the exposed region 210, and the structure of the stoppage protrusion 10 may enhance convenience of matching between the light source board 100 and the heat dissipation plate 200.

In detail, as illustrated in FIG. 4B, an operator (here, the operator may be understood as encompassing the concept of including automation machine equipment, as well as a manual operator) may push the light source board 100 until movement of the light source board 100 is stopped by the stoppage protrusion 10 formed on the heat dissipation plate 200, whereby the light source board 100 may be disposed on the heat dissipation plate 200 such that the first and second spiral shapes are conveniently matched.

Figure 4C:
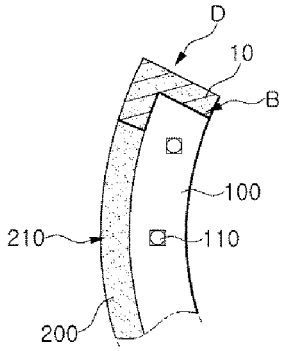

In the present exemplary embodiment, the stoppage protrusion 10 is illustrated as being formed on the entire lateral surface of the exposed region 210 of the heat dissipation plate 200, but the present disclosure is not limited thereto and the stoppage protrusion 10 may only be formed in a portion of the exposed region 210. For example, as illustrated in FIG. 4C, the stoppage protrusion 10 may be provided to be formed in a portion of the exposed region 210 of the heat dissipation plate 200 adjacent to the other end D of the heat dissipation plate 200. In this case, the stoppage protrusion 10 may be in contact with the other end B of the light source board 100.

Figure 5A:
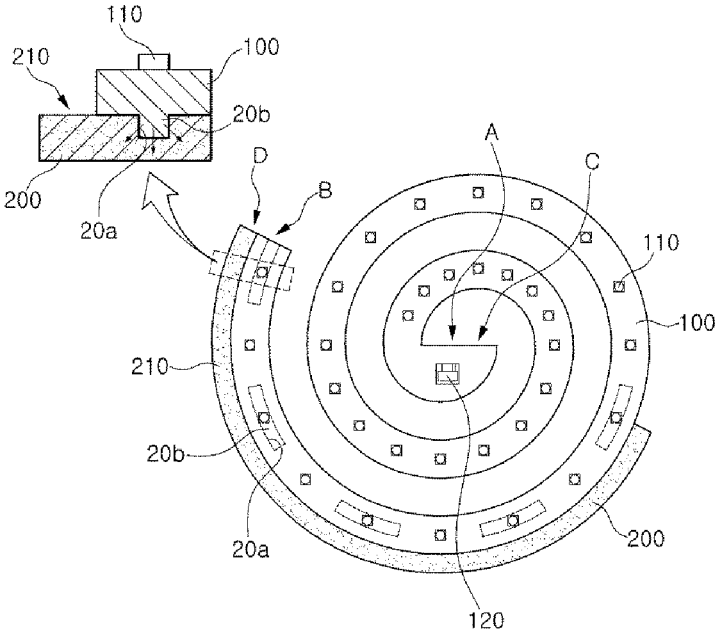
Figure 5B:
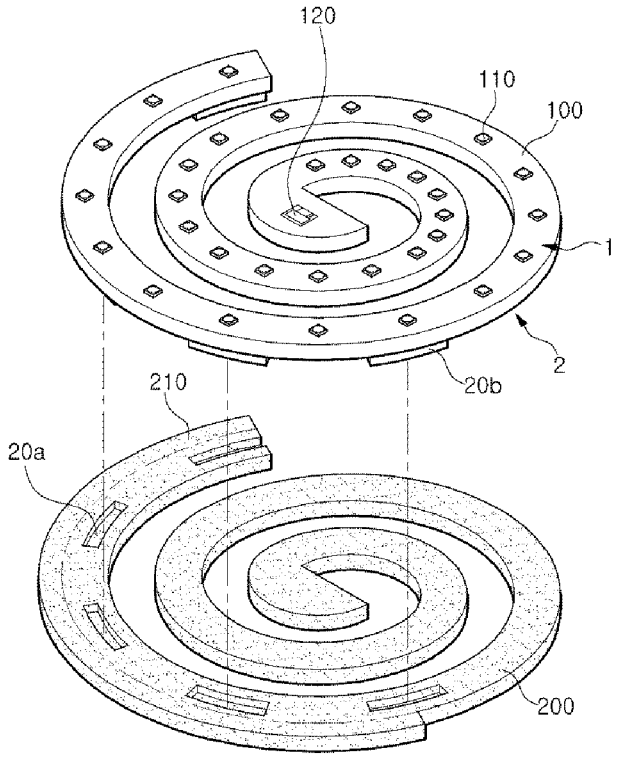

FIGS. 5A and 5B are a plan view and a perspective view illustrating a light emitting module according to a modified exemplary embodiment of FIG. 1.

Referring to FIG. 5A, a light source board 100 may include at least one first protrusion 20*b* formed on the second surface 2. The first protrusion 20*b* may extend in a direction identical to the direction in which the light source board 100 extends from one end A to the other end B.

The heat dissipation plate 200 may include at least one first recess 20*a* formed on the contact surface thereof and accommodating the first protrusion 20*b*. The first recess 20*a* may have a size appropriate for accommodating the first protrusion 20*b*.

In this case, as illustrated in FIG. 5B, the operator may match the first spiral shape of the light source board 100 and the second spiral shape of the contact surface of the heat dissipation plate 200 by simply inserting the first protrusion 20*b* of the light source board 100 into the first recess 20*a* of heat dissipation plate 200.

Also, in the case of the present exemplary embodiment, since an area in which the light source board 100 and the heat dissipation plate 200 are in contact is increased due to the first protrusion 20*b* and the first recess 20*a*, the heat dissipation effect may be further improved.

Meanwhile, in a modified example of the exemplary embodiment illustrated in FIGS. 5A and 5B, the protrusion may be formed in the heat dissipation plate 200 and the recess may be formed in the light source board 100.

Figure 6:
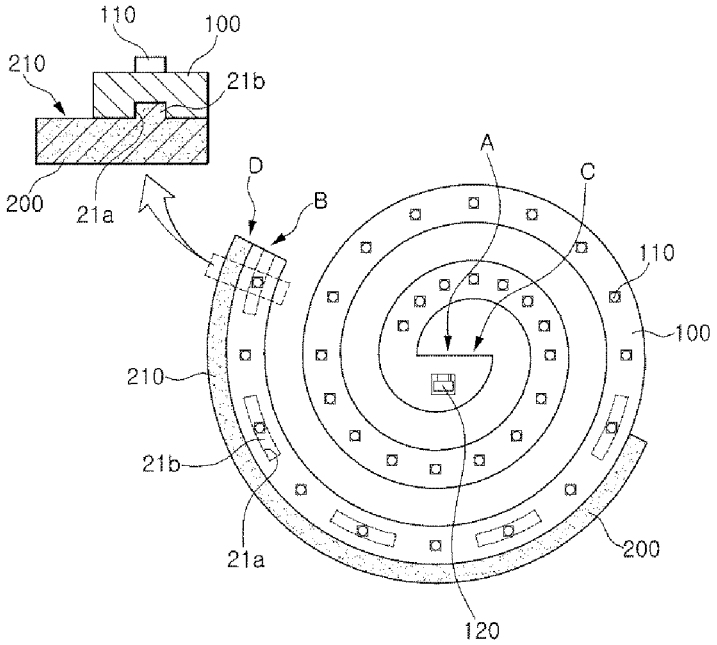

In detail, as illustrated in FIG. 6, the heat dissipation plate 200 may include a second protrusion 21*b* formed on the contact surface thereof, and the light source board 100 may include a second recess 21*a* formed on the second surface 2 and accommodating the second protrusion 21*b*.

In this case, similar to the case described above with reference to FIGS. 5A and 5B, the operator may match the first spiral shape of the light source board 100 and the second spiral shape of the contact surface of the heat dissipation plate 200 by simply inserting the second protrusion 21*b* of the heat dissipation plate 200 into the second recess 21*a* of the light source board 100.

Figure 7A:
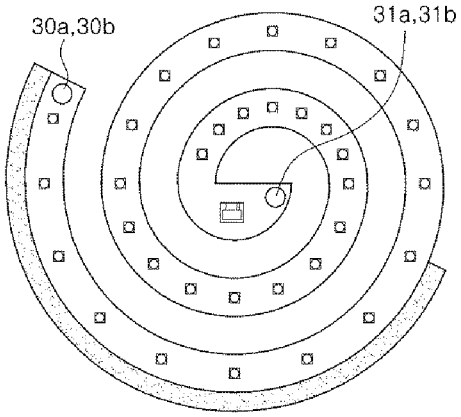
Figure 7B:
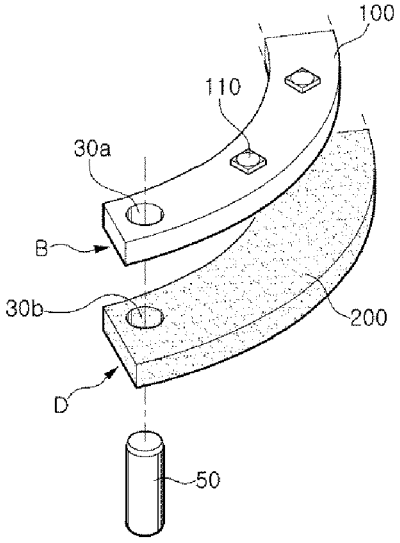
Figure 7C:
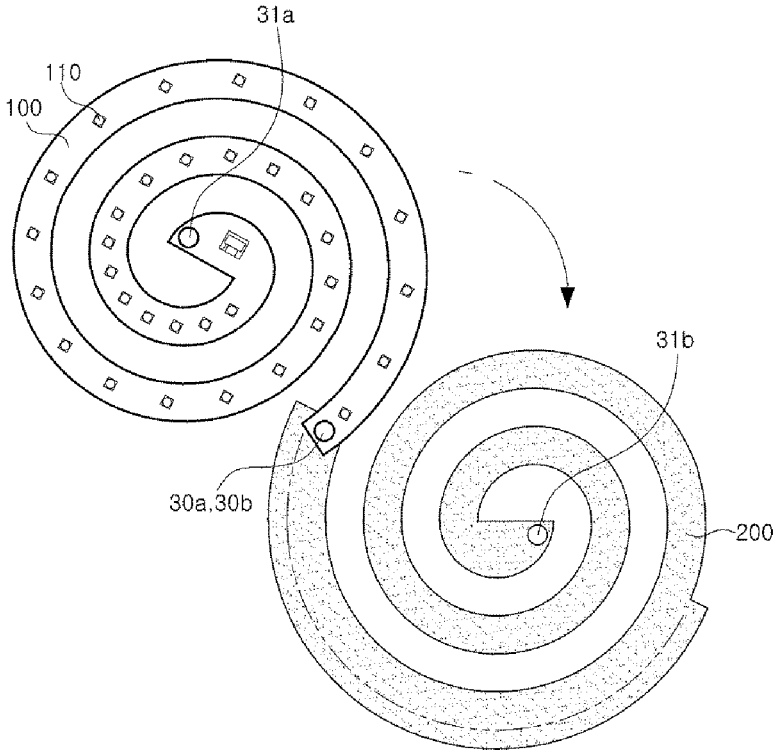

FIGS. 7A through 7C are plan views and a perspective view illustrating a light emitting module according to a modified exemplary embodiment of FIG. 1.

Referring to FIG. 7A, a light source board 100 may include at least one first through holes 30*a* and 31*a* provided to match a first spiral shape of the light source board 100 and a second spiral shape of a contact surface provided in a heat dissipation plate 200.

Two first through holes 30*a* and 31*a* penetrating through from a first surface 1 to a second surface 2 of the light source board 100 are illustrated, but the present disclosure is not limited thereto.

The first through holes 30*a* and 31*a* may be formed in a region adjacent one end A of the light source board 100 and/or a region adjacent to the other end B in order to not to affect the light sources 110 or wiring patterns disposed on the light source board 100. In the present exemplary embodiment, the first through holes 30*a* and 31*a* are illustrated as being formed in a region adjacent one end A of the light source board 100 and a region adjacent the other end B of the light source board 100.

The heat dissipation plate 200 may include at least one of second through holes 30*b* and 31*b* penetrating through the heat dissipation plate 200 in positions corresponding to the first through holes 30*a* and 31*a* of the light source board 100. The second through holes 30*b* and 31*b* may have a shape corresponding to those of the first through holes 30*a* and 31*a* and correspond to the amount of first through holes 30*a* and 31*a*.

Hereinafter, an operation of matching the first spiral shape of the light source board 100 and the second spiral shape of the contact surface of the heat dissipation plate 200 using the first and second through holes 30*a*, 31*a*, 30*b*, and 31*b* will be described. This will be clearly understood with reference to FIGS. 7B and 7C.

First, the operator may insert an auxiliary operating tool 50 into the first and second through holes 30*a* and 30*b*. For example, as illustrated in FIG. 7B, the auxiliary operating tool 50 may be inserted into the first through hole 30*a* formed in a region adjacent the other end B of the light source board 100 and the second through hole 30*b* of the heat dissipation plate 200 formed in a position corresponding thereto. Here, the position of the second through hole 30*b* may be a region adjacent to the other end D of the heat dissipation plate 200.

In the present exemplary embodiment, the auxiliary operating tool 50 is illustrated as being an object having a cylindrical shape, but the present disclosure is not limited thereto. Namely, the present disclosure may be variously implemented. For example, a manual operator may use his fingers without the auxiliary operating tool 50. To this end, the first and second through holes 30*a* and 30*b* may have a size allowing the auxiliary operating tool 50 or the fingers of the manual operator to be inserted thereinto.

Thereafter, as illustrated in FIG. 7C, the operator may relatively rotate the light source board 100 and the heat dissipation plate 200 such that the first through hole 31*a* formed in a region adjacent the one end A and the second through hole 31*b* formed in a position of the heat dissipation plate 200 corresponding to the first through hole 31*a*, for example, the second through hole 31*b* formed in a region adjacent one end C of the heat dissipation plate 200, are matched. In this case, after matching the one first through hole 30*a* and the one second through hole 30*b*, the operator may rotate any one of the light source board 100 and the heat dissipation plate 200 to match the other first through hole 31*a* and the other second through hole 31*b*, whereby the first spiral shape of the light source board 100 and the second spiral shape of the heat dissipation plate 200 may be simply conveniently matched. Thereafter, the operator may fix the light source board 100 and the heat dissipation plate 200 and remove the auxiliary operating tool 50, thus completing the light source module illustrated in FIG. 1.

FIGS. 8A through 8D are plan views and a perspective view illustrating a light emitting module according to a modified exemplary embodiment of FIG. 1.

Figure 8A:
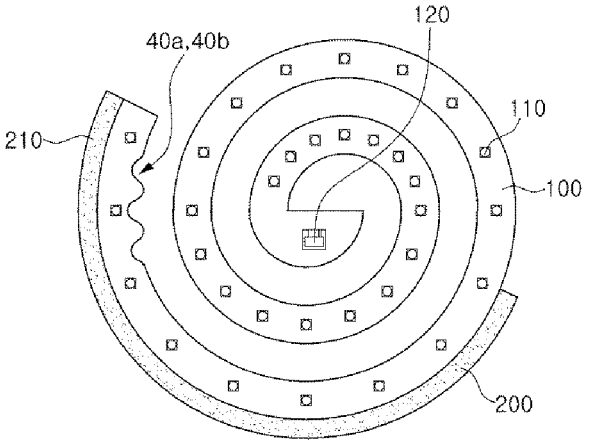

Referring to FIG. 8A, a light source board 100 includes a concavo-convex portion 40*a* provided to facilitate matching between a first spiral shape of the light source board 100 and a second spiral shape of a contact surface provided in a heat dissipation plate 200. The first concavo-convex portion 40*a* may be formed in at least a portion of a lateral surface of the light source board 100.

The heat dissipation plate 200 includes a second concavo-convex portion 40*b* formed in a lateral surface thereof corresponding to the first concavo-convex portion 40*a* of the light source board 100 and having a shape corresponding to that of the first concavo-convex portion 40*a*.

Figure 8B:
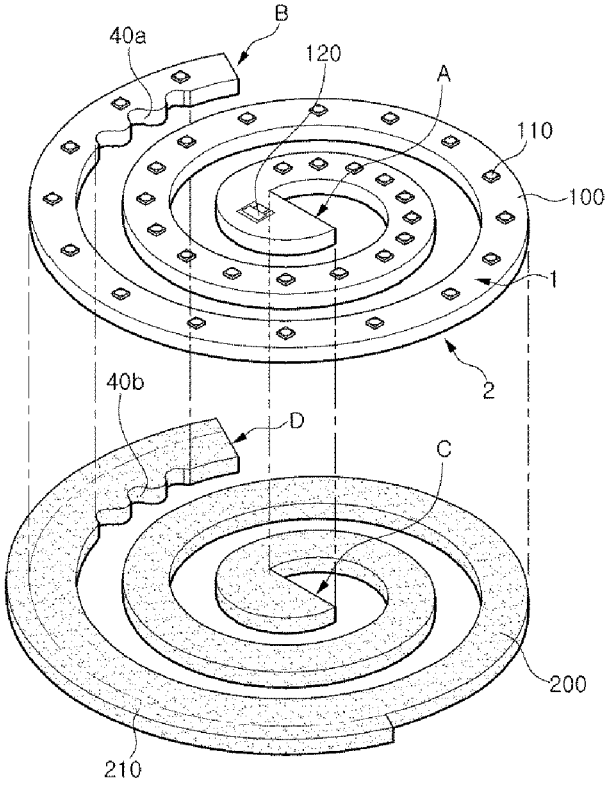

In this case, as illustrated in FIG. 8B, the operator may match a first spiral shape of the light source board 100 and a second spiral shape of the heat dissipation plate 200 by simply aligning the first concavo-convex portion 40*a* formed in the light source board 100 and the second concavo-convex portion 40*b* formed in the heat dissipation plate 200.

In addition, according to the present exemplary embodiment, the concavo-convex structures of the light source board 100 and the heat dissipation plate 200 may increase a surface area in the sides thereof, further increasing a heat dissipation effect.

Figure 8C:
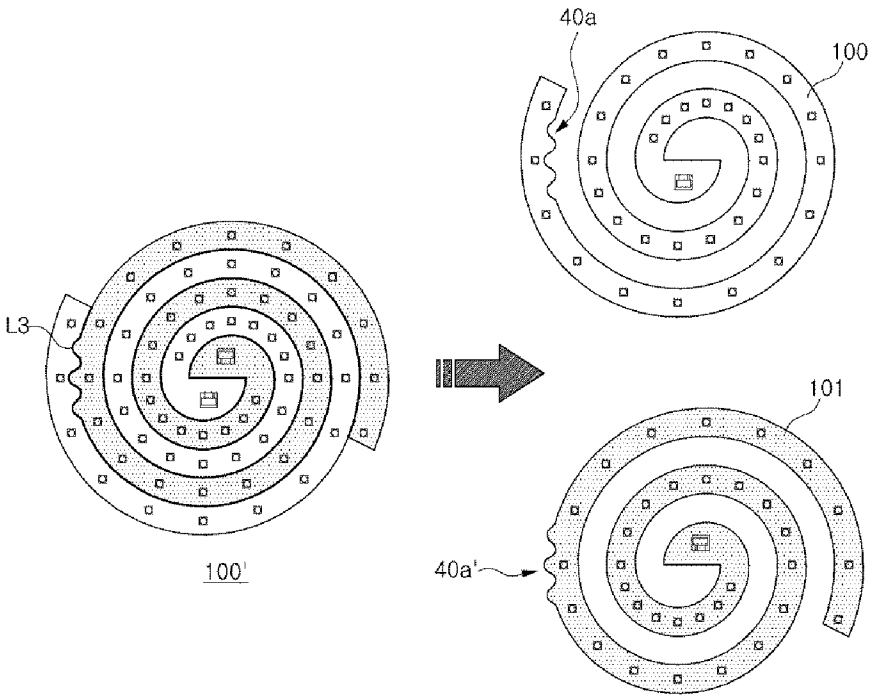

In the present exemplary embodiment, as for the first concavo-convex portion 40*a* formed in the lateral surface of the light source board 100, as illustrated in FIG. 8C, cutting may be performed along a cutting line L3 having depressions and protrusions in separating the single mother board 100' into two light source boards 100 and 101, whereby the first concavo-convex portions 40*a* and 40*a*' may be formed in the respective light source boards 100 and 101.

Figure 8D:
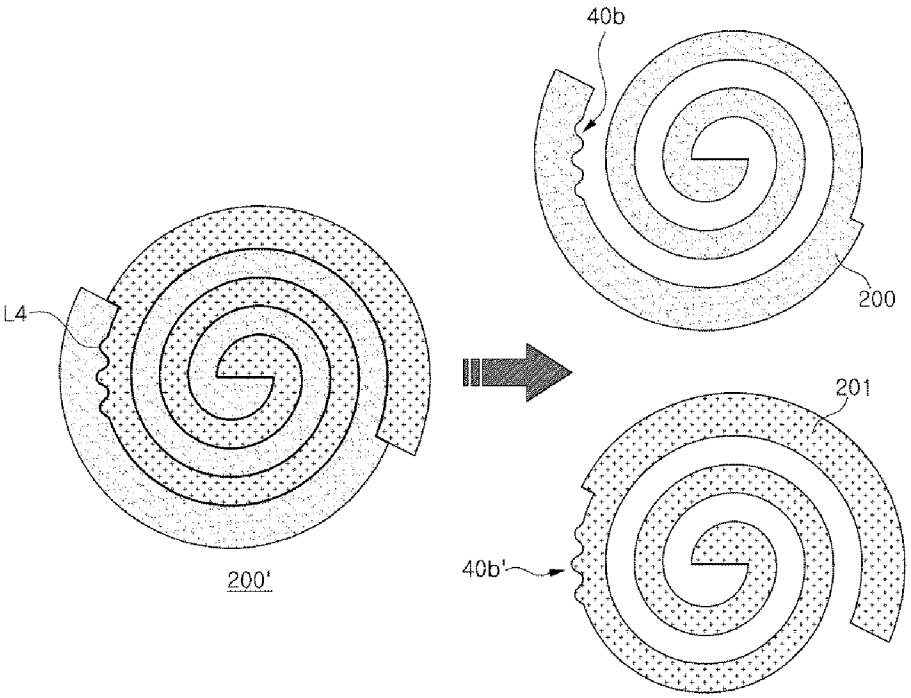

Similarly, as for the second concavo-convex portion 40*b* formed in the lateral surface of the heat dissipation plate 200, as illustrated in FIG. 8D, a cutting operation is performed along a cutting line L4 having depressions and protrusions in separating a single mother heat dissipation plate 200' into two heat dissipation plates 200 and 201, whereby the second concavo-convex portions 40*b* and 40*b*' may be formed in the respective heat dissipation plates 200 and 201.

Figure 9:
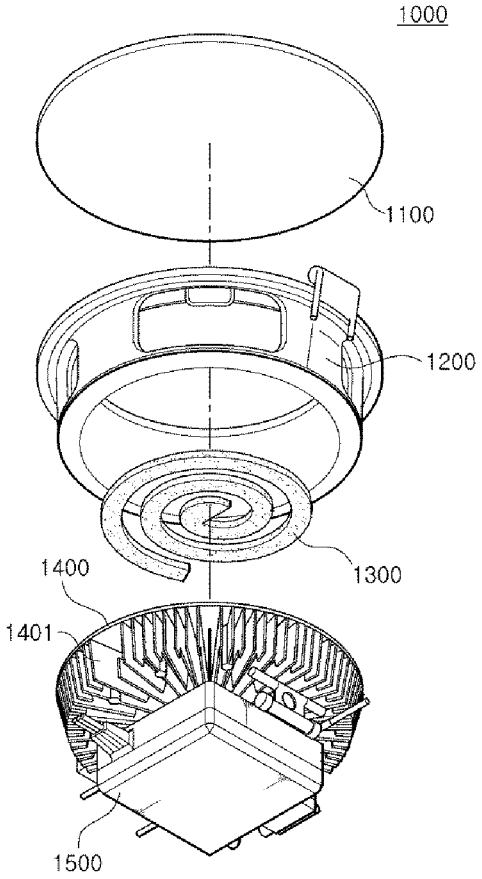
FIGS. 9 through 11 are exploded perspective views illustrating a lighting device employing a light emitting module according to an exemplary embodiment of the present disclosure.
Figure 10:
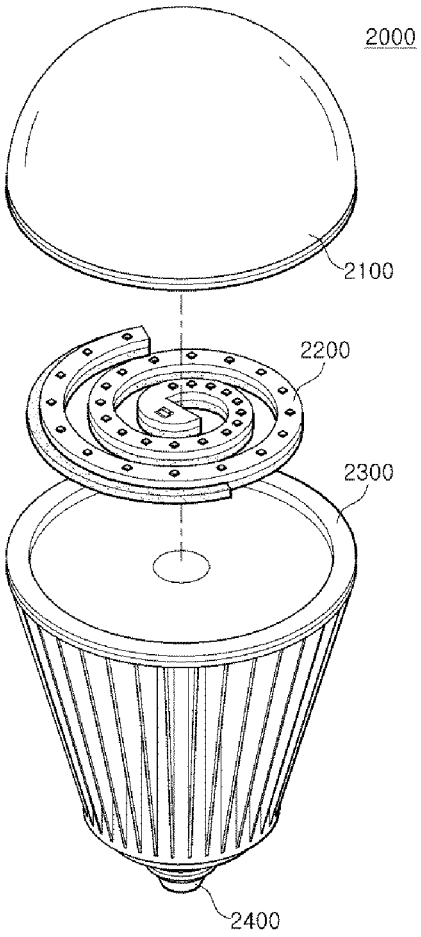
Figure 11:
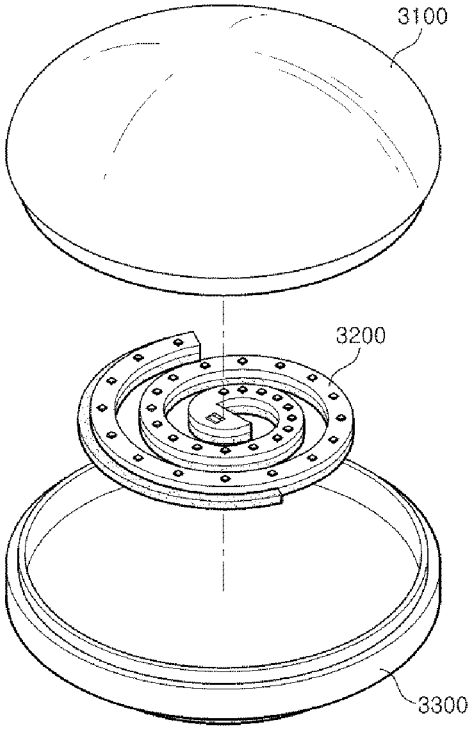

FIGS. 9 through 11 are exploded perspective views illustrating a lighting device employing a light emitting module according to an exemplary embodiment of the present disclosure.

In detail, a light emitting module according to the present exemplary embodiment may be applied to a downlight-type lighting device 1000 as illustrated in FIG. 9.

A downlight is a light fixture installed in a hollow opening formed in a ceiling. When installed, the downlight may locally illuminate an area with high intensity illumination, so it may provide a local highlighting effect or provide a concentrative illumination effect in a desired area, also enhancing an interior decoration effect.

Referring to the exploded perspective view of FIG. 9, a lighting device 1000 according to the exemplary embodiment of the present disclosure may include a cover unit 1100, a housing unit 1200, a light emitting module 1300, a body unit 1400, and a driving unit 1500.

As described above with reference to FIGS. 1 through 8D, the light emitting module 1300 may include a plurality of light sources, a light source board on which the plurality of light sources are disposed, and a heat dissipation plate disposed on a rear surface of the light source board.

The cover unit 1100 may be formed of a material allowing light to be transmitted therethrough. The housing unit 1200 may be provided with an inner wall formed as a reflective surface to allow light generated by the light emitting module 1300 to be effectively irradiated outwardly.

An upper portion of the body unit 1400 may be in direct contact with the heat dissipation plate provided in the light emitting module 1300 to enhance a heat dissipation effect, and in order to further increase the heat dissipation effect, the body unit 1400 may include a plurality of heatsink pins 1401. The body unit 1400 may be formed of a material having excellent thermal conductivity.

In the present exemplary embodiment, the driving unit 1500 receives power from an external source and converts the received power into an appropriate condition for the plurality of light sources provided in the light emitting module 1300 to operate. For example, the driving unit 1500 may include a rectifier, a DC/DC converter, or the like. The driving unit 1500 is illustrated as being disposed below the body unit 1400, but the present disclosure is not limited thereto.

Also, the light emitting module according to an exemplary embodiment of the present disclosure may be applied to a bulb-type lamp as illustrated in FIG. 10. The lighting device may have a shape similar to that of an incandescent lamp to replace a conventional incandescent lamp and may output light having optical characteristics (a color and a color temperature) similar to those of an incandescent lamp.

Referring to the exploded perspective view of FIG. 10, a lighting device 2000 includes a light emitting module 2200 and an external connection unit 2400. The external connection unit 2400 may be connected to an external power source and provide driving power to a plurality of light sources provided in the light emitting module 2200. As described above with reference to FIGS. 1 through 8D, the light emitting module 220 may include a plurality of light sources, a light source board on which the plurality of light sources are disposed, and a heat dissipation plate disposed on a rear surface of the light source board.

Also, the lighting device 2000 may further include an external structure such as a body unit 2300 and a cover unit 2100. An upper portion of the body unit 2300 may be in direct contact with the heat dissipation plate provided in the light emitting module 2200 to enhance a heat dissipation effect. The cover unit 2100 may have a convex lens shape, but the present disclosure is not limited thereto.

Also, the light emitting module according to an exemplary embodiment of the present disclosure may be applied to a surface lighting device 3000 as illustrated in FIG. 11.

Referring to the exploded perspective view of FIG. 11, the lighting device 3000 may include a light emitting module 3200, a base unit 3300, and a cover unit 3100. As described above with reference to FIGS. 1 through 8D, the light emitting module 3200 may include a plurality of light sources, a light source board on which the plurality of light sources are disposed, and a heat dissipation plate disposed on a rear surface of the light source board.

The light emitting module 3200 may be installed within the base unit 3300 and serve to protect the light emitting module 3200 from an external environment. Here, the cover unit 3100 may be disposed above the base unit 3300 and may be formed of a material allowing light to be transmitted therethrough.

In the present exemplary embodiment, the base unit 3300 and the cover unit 3100 are illustrated as having a circular structure, but the present disclosure is not limited thereto. For example, the base unit 3300 and the cover unit 3100 may have a flat quadrangular structure or any other polygonal structure. Configurations of the base unit 3300 and the cover unit 3100 may be variously modified according to lighting design in which light is irradiated.

As set forth above, according to exemplary embodiments of the present disclosure, a light emitting module having excellent heat dissipation efficiency and improved price competitiveness may be obtained.

Advantages and effects of the present disclosure are not limited to the foregoing content and any other technical effects not mentioned herein may be easily understood by a person skilled in the art from the foregoing description.

While exemplary embodiments have been shown and described above, it will be apparent to those skilled in the art that modifications and variations could be made without departing from the spirit and scope of the present disclosure as defined by the appended claims.

What is claimed is:

1. A light emitting module comprising:

a light source board having a first surface and a second surface opposing the first surface and extending from one end to the other end, forming a spiral shape;

at least one light source disposed on the first surface of the light source board; and a heat dissipation plate disposed on the second surface of the light source board and provided with a contact surface having a spiral shape corresponding to that of the light source board, wherein the contact surface of the heat dissipation plate is provided with an exposed region not covered by the second surface of the light source board.

2. The light emitting module of claim 1, wherein the heat dissipation plate includes at least one of materials selected from the group consisting of Ag, Al, Ni, Cr, Cu, Au, Pd, Pt, Sn, W, Rh, Ir, Ru, Mg, Zn, Ti, and alloys thereof.

3. The light emitting module of claim 1, wherein the heat dissipation plate further includes a stoppage protrusion disposed on the exposed region and contacting at least one of a lateral surface and the other end of the light source board.

4. The light emitting module of claim 1, wherein the light source board further includes at least one first protrusion disposed on the second surface thereof, and the heat dissipation plate further includes at least one first recess disposed in the contact surface thereof and accommodating the at least one first protrusion.

5. The light emitting module of claim 1, wherein the heat dissipation plate further includes at least one second protrusion disposed on the contact surface, and the light source board further includes at least one second recess disposed in the second surface and accommodating the at least one second protrusion.

6. The light emitting module of claim 1, wherein a thickness of the light source board ranges from about 0.6 mm to about 1.6 mm.

7. The light emitting module of claim 1, wherein the light source includes a semiconductor light emitting device.

8. The light emitting module of claim 1, wherein the light source board further includes a first concavo-convex portion disposed in at least a portion of a lateral surface thereof and provided to match the spiral shape of the light source board and the spiral shape of the contact surface provided in the heat dissipation plate, and the heat dissipation plate further includes a second concavo-convex portion disposed in a lateral surface thereof corresponding to the first concavo-convex portion of the light source board and having a shape corresponding to that of the first concavo-convex portion.

9. The light emitting module of claim 1, wherein a lateral surface of the light source board has a V-type cutaway surface.

10. The light emitting module of claim 1, wherein the light source board is a printed circuit board (PCB) on which a wiring pattern providing driving power to the at least one light source is formed.

11. The light emitting module of claim 1, wherein the first surface of the light source board is provided as a reflective surface.

12. A light emitting module comprising:

a light source board having a first surface and a second surface opposing the first surface and extending from one end to the other end, forming a spiral shape;

at least one light source disposed on the first surface of the light source board; and a heat dissipation plate disposed on the second surface of the light source board and provided with a contact surface having a spiral shape corresponding to that of the light source board, wherein the light source board includes at least one first through hole penetrating the light source board and provided to match the spiral shape of the light source board and the spiral shape of the contact surface provided in the heat dissipation plate, and the heat dissipation plate includes at least one second through hole penetrating the heat dissipation plate in a position corresponding to that of the first through hole of the light source board and having a shape corresponding to that of the first through hole.

13. The light emitting module of claim 12, wherein the first through hole is disposed in at least one of a region adjacent the one end of the light source board and a region adjacent the other end of the light source board.

14. A light emitting module comprising:

a plurality of light sources;

a light source board having a first surface on which the plurality of light sources are disposed and a second surface opposing the first surface, and having a first spiral shape; and a heat dissipation plate disposed on the second surface of the light source board, and extending from one end to the other end, forming a second spiral shape corresponding to the first spiral shape, wherein one of the light source board and the heat dissipation plate includes at least one protrusion, and the other one of the light source board and the heat dissipation plate includes at least one recess accommodating the at least one protrusion.

* * * * *